US007866989B1

(12) United States Patent
Zhu

(10) Patent No.: US 7,866,989 B1
(45) Date of Patent: Jan. 11, 2011

(54) ELECTRICAL CONNECTOR SEATED IN PRINTED CIRCUIT BOARD

(75) Inventor: Yu Zhu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/790,890

(22) Filed: May 31, 2010

(51) Int. Cl.
*H01R 12/00* (2006.01)

(52) U.S. Cl. ..... 439/79

(58) Field of Classification Search ..... 439/79, 439/660

See application file for complete search history.

(56) References Cited

U.S. PATENT DOCUMENTS 7,753,737 B2 * 7/2010 Yang et al. ..... 439/79
2009/0029567 A1 * 1/2009 Yi ..... 439/66

* cited by examiner

*Primary Examiner*—Tho D Ta
(74) *Attorney, Agent, or Firm*—Wei Te Chung; Andrew C. Cheng; Ming Chieh Chang

(57) ABSTRACT

An electrical connector assembly includes an insulating housing and a plurality of terminals. The housing defines a base portion, a tongue portion extending forward from the base portion and a pair of mounting portions respectively defined at longitudinal ends of the base portion. The tongue portion defines a plurality of passageways for receiving the terminals respectively. The base portion has a top face being lower than a top face of the mounting portion.

9 Claims, 5 Drawing Sheets

ELECTRICAL CONNECTOR SEATED IN PRINTED CIRCUIT BOARD

BACKGROUND OF THE INVENTION

1. Field of the Invention

The present invention relates to an electrical connection, and particularly to an electrical connector seated in a notch of a printed circuit board.

2. Description of Related Arts

FIG. 1 discloses an electrical connector 100' which is used for an interface in a memory device. The electrical connector 100' is mounted on a printed circuit board 10', and comprises an insulating housing 20' and a plurality of terminals 30' received in the housing 20'. The housing 20' defines a base portion 21', a tongue portion 22' extending forward from the base portion 21', a pair of mounting portion 23' respectively defined at longitudinal ends of the base portion 21', and a top wall 24' unitarily extending horizontal and forward from a front face of the base portion 21'. The top wall 24' has an upper face falling on same level with an upper face of the mounting portion 23'. The upper faces of the top wall 24' and the mounting portion 23' are higher than upper face of the printed circuit board 10'. However, as connectors are intended to be miniaturized to cater for the miniature trend of electrical devices, these connectors will have their bodies much thinner along the widths of the bodies.

Hence, a new electrical connector is desired.

SUMMARY OF THE INVENTION

A major object of the present invention of to provide a miniature electrical connector, which can lower the connector on a printed circuit.

An electrical connector assembly comprises an insulating housing and a plurality of terminals. The housing defines a base portion, a tongue portion extending forward from the base portion and a pair of mounting portions respectively defined at longitudinal ends of the base portion. The tongue portion defines a plurality of passageways for receiving the terminals respectively. The base portion has a top face being lower than a top face of the mounting portion.

Other advantages and novel features of the invention will become more apparent from the following detailed description of the present embodiment when taken in conjunction with the accompanying drawings

DETAILED DESCRIPTION OF THE PREFERRED EMBODIMENT

Further detailed description of the preferred embodiments of this present invention is set forth below along with the attached drawings.

Figure 1:
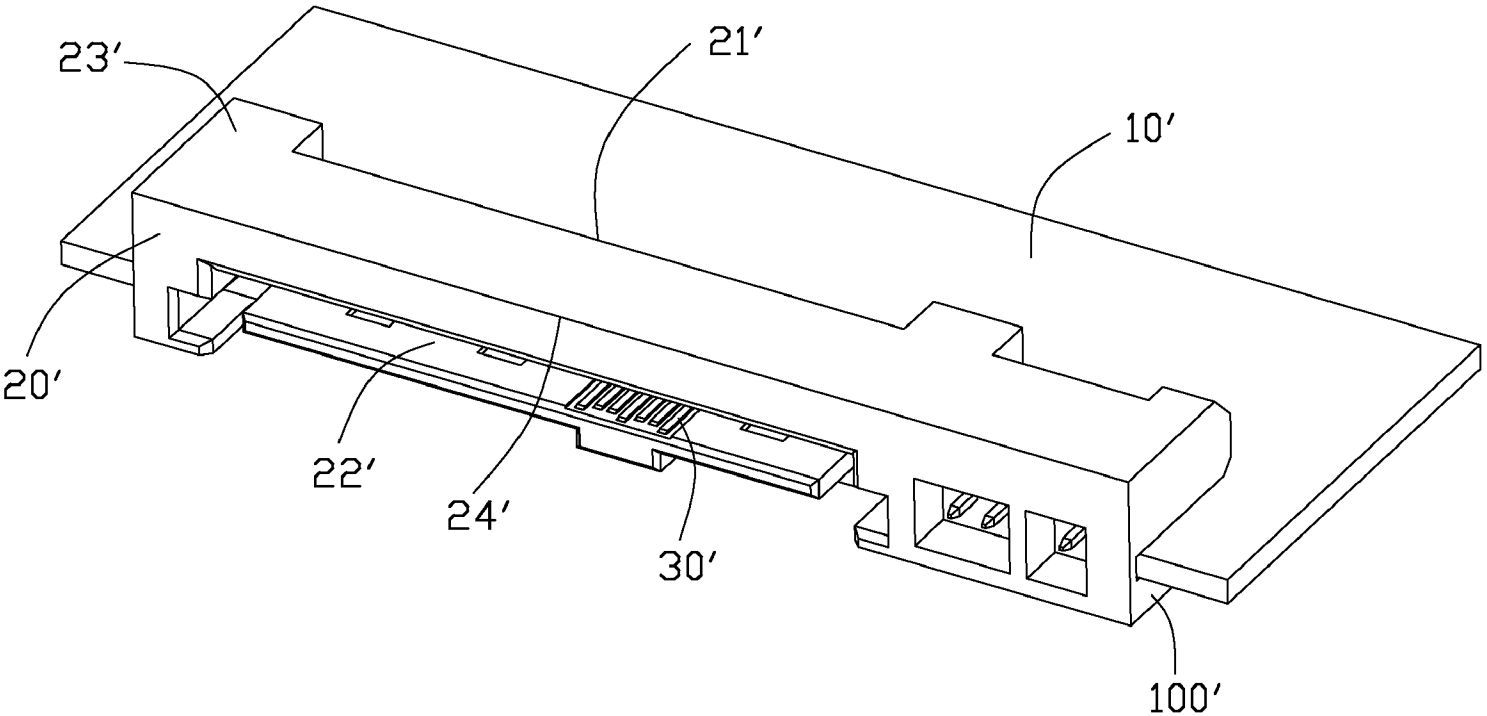
FIG. 1 (PRIOR ART)
FIG. 1 is an assembled perspective view of an electrical connector assembly in the prior art.
Figure 2:
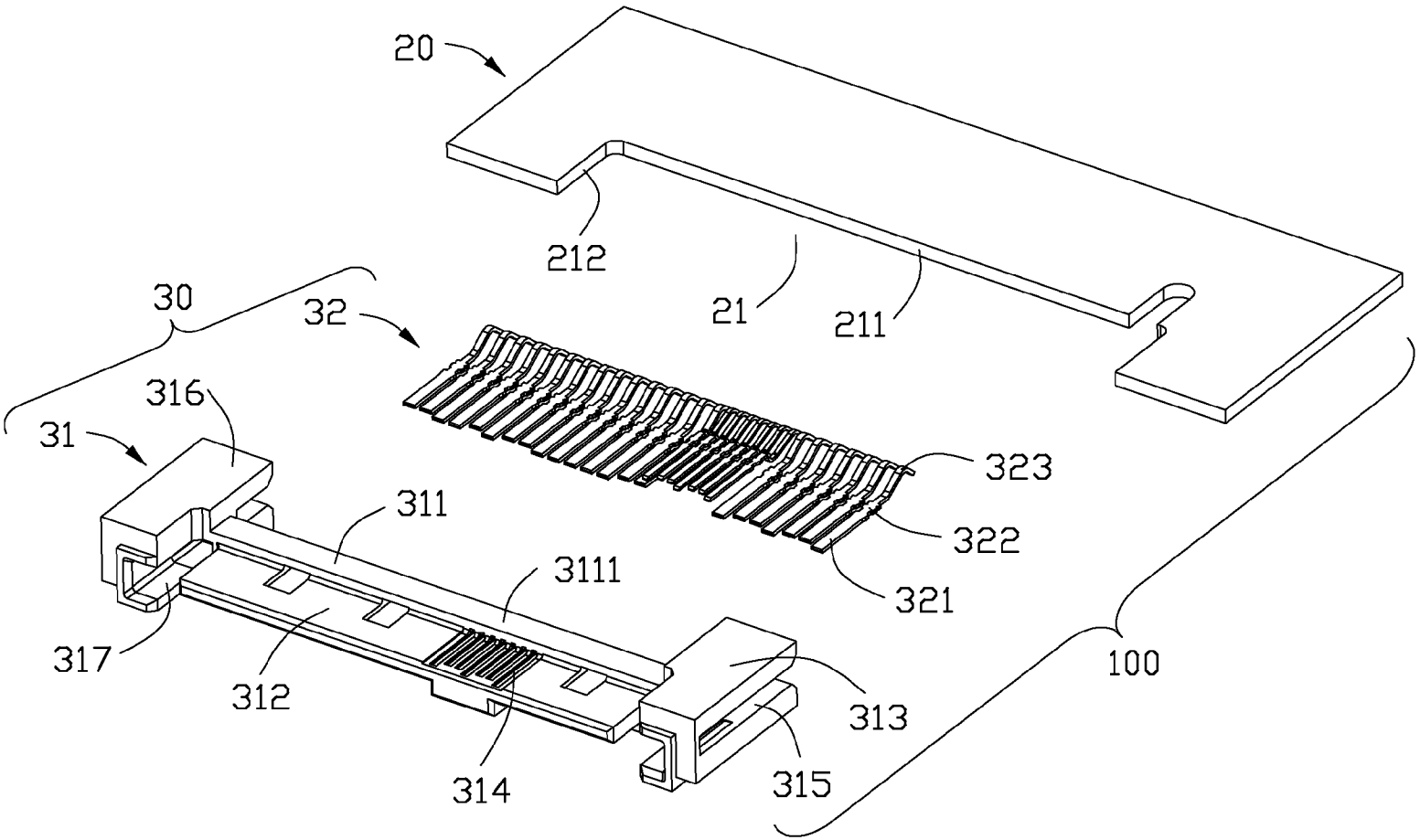
FIG. 2 is an exploded perspective view of the electrical connector assembly in accordance with the present invention.
Figure 3:
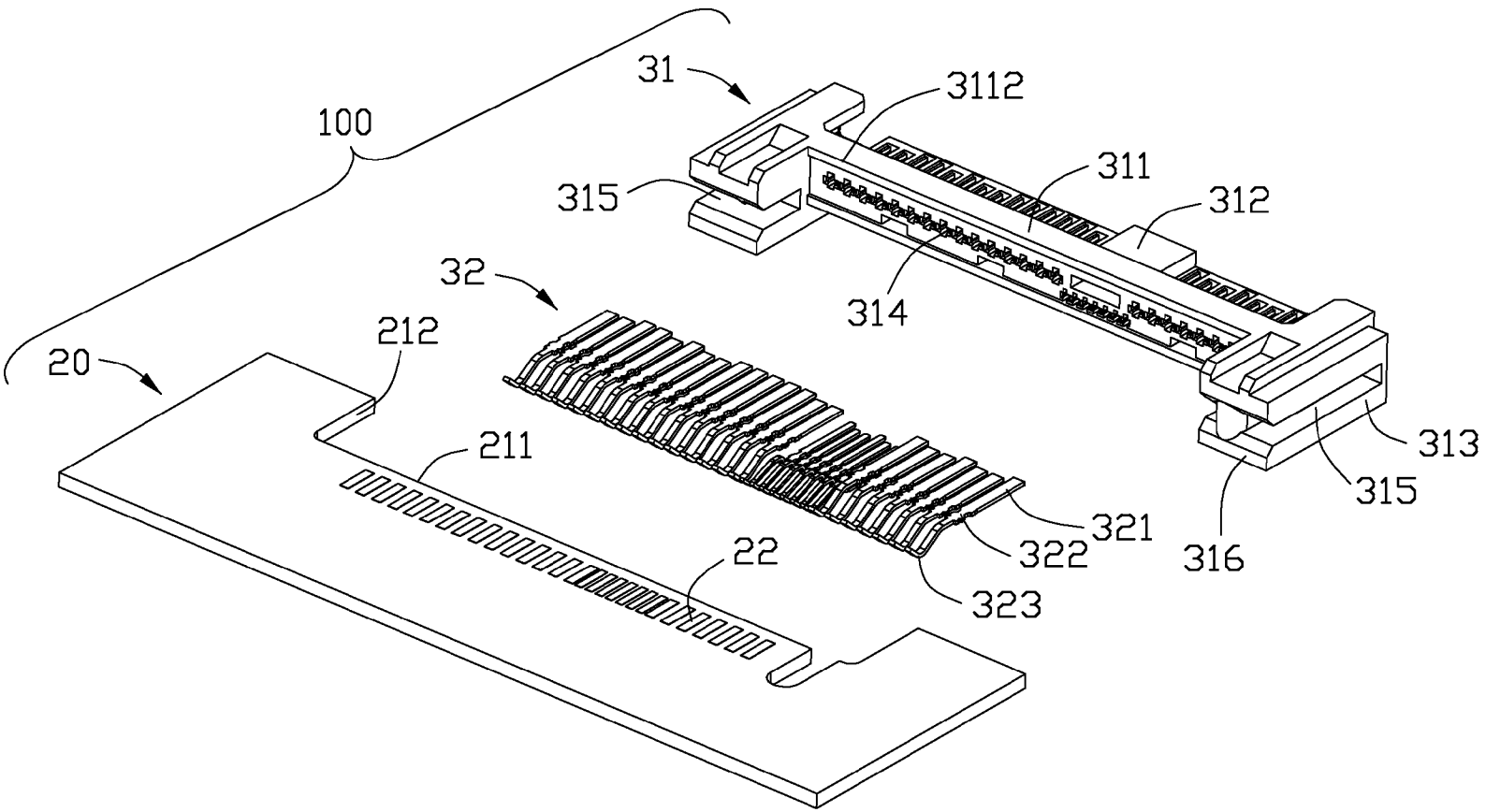
FIG. 3 is an exploded perspective view of the electrical connector assembly from another view.
Figure 4:
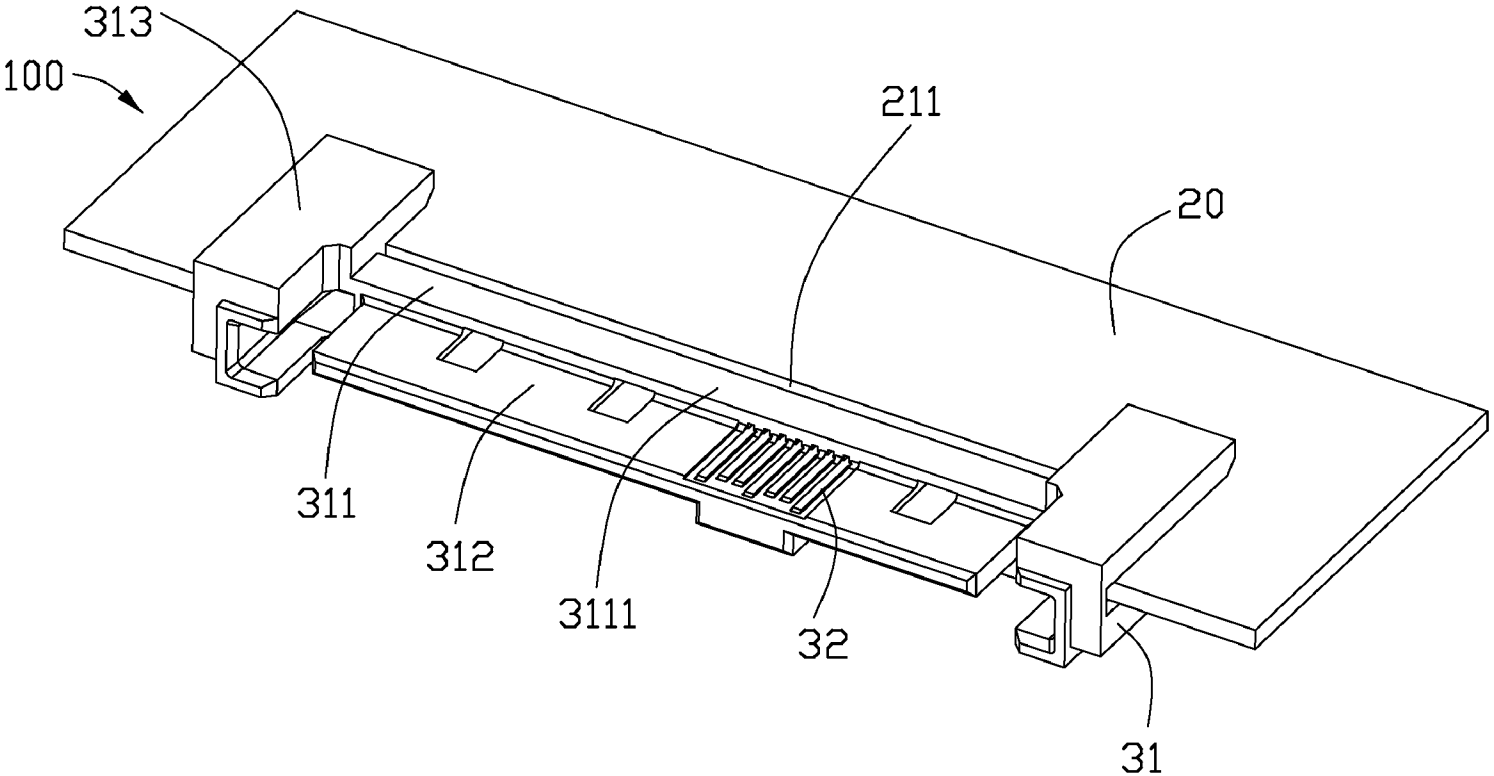
FIG. 4 is an assembled perspective view of the electrical connector assembly.
Figure 5:
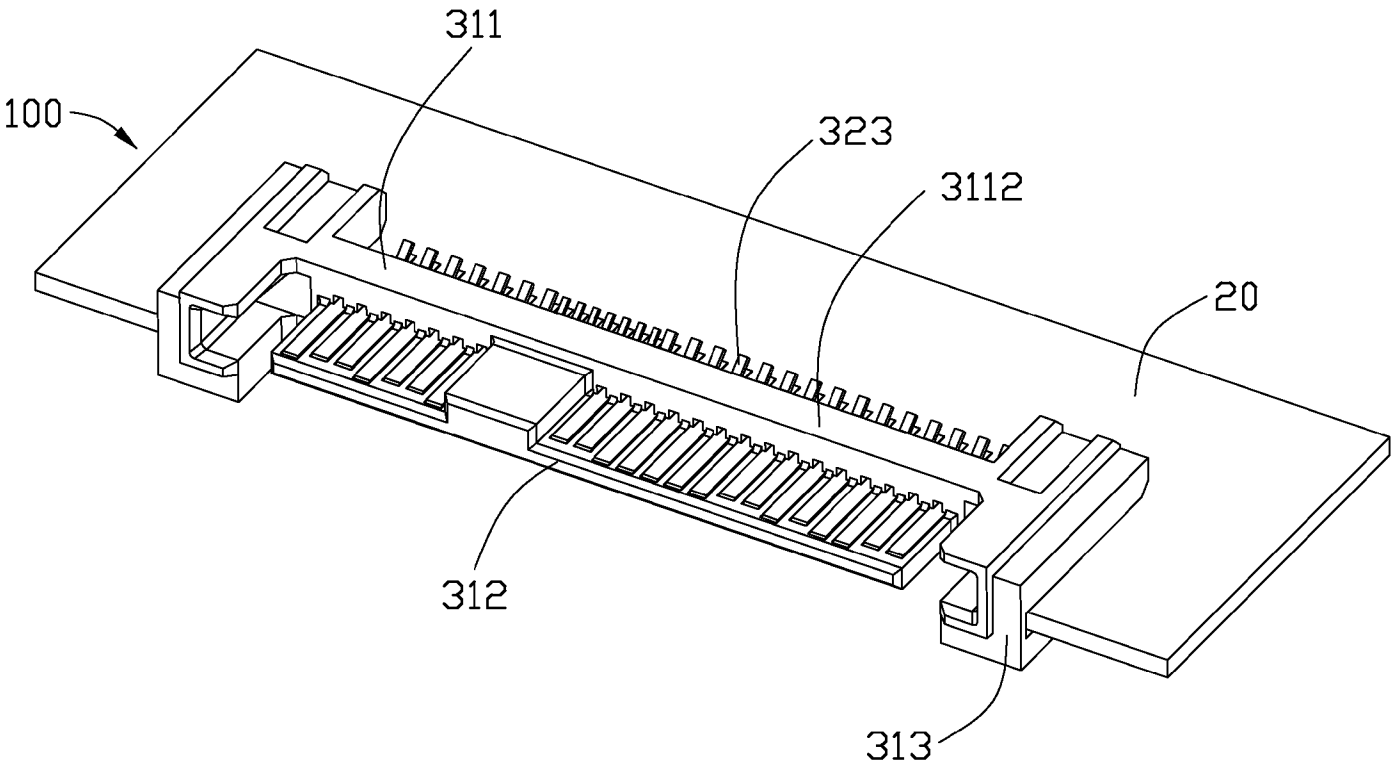
FIG. 5 is an assembled perspective view of the electrical connector assembly from another view.

Referring to FIGS. 2-5, an electrical connector assembly 100 comprises a printed circuit board 20 and an electrical connector 30 mounted on the printed circuit board 20.

The printed circuit board 20 defines a rectangular-shaped notch 21 having a longitudinal edge 211 and a pair of transverse edges 212 respectively jointly connecting with two ends of the longitudinal edge 211. The printed circuit board 20 has an upper face and a lower face with a plurality of conductive pads 22 arranged thereof along the longitudinal edge 211.

The electrical connector 30 comprises an insulating housing 31 and a plurality of terminals 32 received in the housing 31.

The housing 31 defines a rectangular-shaped base portion 311, a tongue portion 312 extending forward from a front face of the base portion 311, and a pair of mounting portions 313 defined at longitudinal ends of the base portion 311. The base portion 311 and the tongue portion 312 are defined to load the terminals, thereby going by the general name of terminal-located portion. The base portion 311 defines a top face 3111 being higher than the tongue portion 312 and a bottom face 3112 being lower than the tongue portion 312. Alternatively, the top face 3111 of the base portion 311 can be lower to a same level with a top face of the tongue portion 312, which can lower the connector 30 as maximum as possible. The tongue portion 312 defines a plurality of passageways 314 extending through the base portion 311. A pair of guiding slots 317 in the inside of the mounting portion 313 and separately located at two ends of the tongue portion 312 to commonly define a mating cavity (not labeled). The mounting portions 313 define a pair of first grooves 315 in the outside thereof running through a rear face of the mounting portions 313, which stop near to the front face thereof. A pair of second grooves 318 at the rear face of the mounting portions 313 running therethrough along the longitudinal direction of the base portion 311. The first and second grooves 315, 318 communicate with each other to receive the edges 211, 212 of the notch 21 of the PCB 20, i.e. the edges 211, 212 of the PCB 20 are sandwiched by the upper and lower retaining portion 316 of the mounting portion 313.

The terminal 32 defines a contacting portion 321, a body portion 322 extending rearward from the contacting portion 321 and a soldering portion 323 extending rearward from the body portion 322.

When assembly, firstly, the terminals 32 are assembled to the insulating housing 31, with the contacting portions 321 and the body portions 322 of the terminals 32 respectively inserted into the terminal passageways 314 of the housing 31. Secondly, the housing 31 with the terminals 32 is mounted to the notch 21 of the print circuit board 20 by the mounting portion 313, and the base portion 311 is abutted to the longitudinal edge 211 of the notch 21, and the first and second grooves 315, 318 and the retaining portions 316 are respectively engaged with the of the longitudinal edge 211 and the transverse edges 212 of the notch 21 of the printed circuit board 20. In addition, the soldering portions 323 of the terminals 32 are respectively fixed onto the conductive pads 22 of the printed circuit board 20.

The top face 3111 of the base portion 311 of housing 31 is lower than the top face of the notch 21 of the print circuit board 20 so that the space on the top face of the PCB 20 opposite to the conductive pads 22 on the lower face of the PCB 20 is reserved to receive other components or circuits. Please note the top face of the base portion 311 is higher than the top face of the tongue portion 312 to ensure the terminals 32 are retained in the base portion 311. The top face 3111 of the base portion 311 is lower than the top face of the mounting portion 313. With these designs, the electrical connector 30 has its base portion 311 much thinner along the width so as to save the space of the printed circuit board 20. Since the first and second grooves 315, 318 are to receive the edges of the PCB 20, the inner faces of the grooves 315, 318 are in a same level with the top face and lower face of the PCB 20. The groove 315 has a top or first inside face and a lower or second inside face opposite to the first inside face. The first inside face of the groove 315 is higher than corresponding surface of the terminal-located portion (i.e. base portion 311 and tongue portion 312) and the second inside face of the groove 315 is lower than corresponding surface of the terminal-located portion. The plane of the soldering portion 323 is in a same level with the lower face of the PCB 20 so that the plane of the soldering portions 323 is in a same level with the second inside face of the groove 315.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

I claim:

1. An electrical connector assembly comprising:

a print circuit board defining a first face, a second face opposite to the first face and a notch;

an insulating housing seating in the notch of the printed circuit board and defining a base portion, a tongue portion extending forward from the base portion and a pair of mounting portions respectively defined at two opposite ends of the base portion; and a plurality of terminals running through the base portion and comprising contacting portions in the tongue portion and soldering portions exposing to a rear face of the base portion and connecting with the second face of the printed circuit board;

wherein the base portion defines a top face at a same side of the first face of the printed circuit board while the top face is lower than the first face of print circuit board and is higher than corresponding top face of the tongue portion;

wherein the mounting portions defines a pair of first grooves in the outside thereof running through a rear face of the mounting portions;

wherein a pair of second grooves are defined in the rear face of the mounting portion running therethrough along a longitudinal direction of the base portion;

wherein the notch has a longitudinal edge and a pair of transverse edges respectively jointly connecting with two ends of the longitudinal edge, said edges are received in the first and second grooves.

2. The electrical connector assembly as described in claim 1, wherein a pair of guiding slots in the inside of the mounting portion and separately located at two ends of the tongue portion to commonly define a mating cavity.

3. An electrical connector comprising:

a plurality of terminals comprising contacting portions and soldering portions;

an insulating housing comprising a terminal-located portion which is arranged with the terminals and a pair of mounting portions at two opposite ends of the terminal-located portion, the soldering portions exposing to a rear face of the insulating housing;

each of the mounting portions defining a groove which is used for retaining the insulating housing in a PCB, running through the rear face of the insulating housing, the groove having a first inside face and a second inside face opposite to the first inside face;

wherein the terminal-located portion has two surfaces, the first inside face of the groove is higher than corresponding surface of the terminal-located portion and the second inside face of the grooves is lower than corresponding surface of the terminal located portion when the insulating housing is mounted to the PCB.

4. The electrical connector as described in claim 3, wherein the solder portions of the terminals are parallel to the second inside face of the groove.

5. The electrical connector as described in claim 3, wherein the terminal-located portion defines a base portion having a first face, the first face of the base portion is lower than corresponding face of the mounting portion.

6. An electrical connector assembly comprising:

a printed circuit board defining a large notch along a front longitudinal edge thereof in a longitudinal direction, a small notch communicatively formed behind the large notch adjacent to one longitudinal end of said notch;

opposite first and second surfaces formed on the printed circuit board;

a plurality of conductive pads formed on the first surface adjacent to said large notch;

an electrical connector including:

an insulative elongated housing assembled to the printed circuit board in a front-to-back direction perpendicular to said longitudinal direction, and including:

a base portion received in the large notch and essentially intimately confronting the front longitudinal edge of the printed circuit board behind the large notch;

a mating tongue extending forwardly from the base portion;

a pair of mounting portions located at two opposite longitudinal ends of the base portion, each of said mounting portions defining a horizontal groove to receive the printed circuit board therein under condition that opposite first and second retaining portions thereof abut against the corresponding first and second surfaces, respectively, for restricting relative movement of the housing with regard to the printed circuit board in a vertical direction perpendicular to both said longitudinal direction and said front-to-back direction, one of said mounting portions further defining a protrusion formed in the corresponding horizontal groove to be received in the small notch for restricting relative movement of the housing with regard to the printed circuit board in the longitudinal direction; and a plurality of terminals disposed in the housing, each of said terminals defining a mating section located upon the mating tongue, and a mounting section mechanically and electrically connected to the corresponding conductive pad; wherein the base portion defines opposite first and second faces in the vertical direction, under condition that said first face, which faces toward a same first direction with the first surface of the printed circuit board, is essentially located outside of the large notch in the vertical direction, while said second face, which faces toward a same second direction with the second surface of the printed circuit board, is essentially located inside of the large notch in said vertical direction.

7. The electrical connector assembly as claimed in claim 6, wherein the mating tongue defines opposite first and second mating faces respectively facing toward the first and second directions under condition that both said first and second mating faces are located outside of the large notch in said vertical direction.

8. The electrical connector assembly as claimed in claim 7, wherein both said first and second mating faces of the mating tongue are equipped with the mating sections of the corresponding terminals while all the conductive pads are only applied to the first surface of the printed circuit board.

9. The electrical connector assembly as claimed in claim 8, wherein the terminal having the mating section on the second mating face of the mating tongue, defines an offset section between the corresponding mating section and mounting section so as to allow the corresponding mounting section to be mounted to the first surface of the printed circuit board.

* * * * *